US010213927B2

(12) United States Patent
Chiu

(10) Patent No.: US 10,213,927 B2
(45) Date of Patent: Feb. 26, 2019

(54) UTILITY KNIFE

(71) Applicant: GOODLY-CH ENTERPRISE CO., LTD., Taichung (TW)

(72) Inventor: Chin-Chang Chiu, Taichung (TW)

(73) Assignee: GOODLY-CH ENTERPRISE CO., LTD., Taichung (TW)

( * ) Notice: Subject to any disclaimer, the term of this patent is extended or adjusted under 35 U.S.C. 154(b) by 132 days.

(21) Appl. No.: 14/929,529

(22) Filed: Nov. 2, 2015

(65) Prior Publication Data

US 2017/0021511 A1 Jan. 26, 2017

(30) Foreign Application Priority Data

Jul. 20, 2015 (TW) ..... 104123415 A

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01)

(58) Field of Classification Search
CPC ..... B26B 1/08; B26B 5/003
USPC ..... 30/162
See application file for complete search history.

(56) References Cited

U.S. PATENT DOCUMENTS 3,906,627 A * 9/1975 Manning ..... B26B 5/003 30/162
4,139,939 A * 2/1979 Crooks ..... B26B 1/08 30/162
4,805,304 A * 2/1989 Knoop ..... B26B 5/003 30/162
5,086,562 A * 2/1992 Jacoff ..... B26B 5/00 30/162
5,121,544 A * 6/1992 Gilbert ..... B26B 5/001 30/162
5,495,670 A 3/1996 Quinn
5,581,890 A * 12/1996 Schmidt ..... B26B 5/003 30/162
5,806,189 A * 9/1998 Bailey ..... B26B 5/001 30/162
5,813,121 A * 9/1998 Gringer ..... B26B 5/003 30/162

(Continued)

FOREIGN PATENT DOCUMENTS

DE 29819618 U1 1/1999
DE 202013101416 U1 6/2013

(Continued)

*Primary Examiner* — Jason Daniel Prone
(74) *Attorney, Agent, or Firm* — Alan D. Kamrath; Kamrath IP Lawfirm, P.A.

(57) ABSTRACT

A utility knife includes a shell including first and second shell bodies releasably assembled together. A compartment is defined by the first and second shell bodies. A channel is defined at a distal end of the first shell body of the shell and is disposed outside of the compartment. A blade carrier assembly releasably engages with a blade and includes a seat movably received by compartment of the shell. The blade carrier assembly is operably movable to a first position in which the blade is in a retracted position and not extending out of the shell and, to a second position in which the blade is in an exposed position and extending out of the shell. The blade carrier assembly in the second position thereof is also guided by the channel.

17 Claims, 7 Drawing Sheets

(56) References Cited

U.S. PATENT DOCUMENTS 5,878,501 A 3/1999 Owens et al.
5,966,817 A * 10/1999 Lee ..... B26B 5/001 30/162
6,041,505 A * 3/2000 Chen ..... B26B 1/08 30/162
6,058,607 A * 5/2000 Gringer ..... B26B 5/003 30/162
6,148,522 A * 11/2000 Dobandi ..... B26B 5/001 30/162
6,192,589 B1 * 2/2001 Martone ..... B26B 5/001 30/162
6,276,014 B1 * 8/2001 Lee ..... B26B 5/001 30/162
6,513,246 B2 * 2/2003 Ping ..... B26B 5/001 30/162
6,546,632 B2 * 4/2003 Gilbert ..... B26B 5/001 30/162
6,742,260 B1 * 6/2004 Hsu ..... B26B 5/001 30/162
6,829,827 B2 * 12/2004 Tseng ..... B26B 5/001 30/162
7,100,285 B1 * 9/2006 Huang ..... B26B 5/001 30/162
7,121,006 B2 * 10/2006 Sun ..... B26B 5/001 30/162
7,131,204 B2 * 11/2006 Brown ..... B26B 5/001 30/162
7,516,550 B2 * 4/2009 Hagan ..... B23D 51/01 30/162
7,621,051 B2 * 11/2009 Ping ..... B26B 1/042 30/162
7,774,942 B2 * 8/2010 Schmidt ..... B26B 5/001 30/162
7,797,837 B2 * 9/2010 Wu ..... B26B 5/001 30/162
7,891,098 B2 * 2/2011 Parker ..... B26B 5/003 30/162
8,220,161 B2 * 7/2012 Chang ..... B26B 5/001 30/162
8,375,588 B2 * 2/2013 Gringer ..... B26B 5/001 30/162
8,567,071 B2 * 10/2013 Strauss ..... B26B 5/001 30/162
8,572,852 B1 * 11/2013 Jennings ..... B26B 5/003 30/162
8,595,942 B2 * 12/2013 Ho ..... B26B 5/003 30/162
8,683,703 B2 * 4/2014 Rowlay ..... B26B 5/001 30/162
8,857,064 B2 * 10/2014 Schmidt ..... B26B 5/003 30/162
8,904,649 B2 * 12/2014 Garavaglia ..... B26B 5/001 30/162
9,102,068 B2 * 8/2015 Gringer ..... B26B 1/08 30/162
9,364,958 B2 * 6/2016 Scimone ..... B26B 5/003 30/162
D767,361 S * 9/2016 Chiu ..... D8/99
9,550,302 B2 * 1/2017 Spaulding ..... B26B 5/001 30/162
2004/0000055 A1 * 1/2004 Lee Fan ..... B26B 5/001 30/162
2005/0172496 A1 * 8/2005 Zeng ..... B26B 5/001 30/162
2005/0283983 A1 * 12/2005 Huang ..... B26B 5/001 30/162
2008/0271322 A1 * 11/2008 Chen ..... B26B 5/001 30/162
2009/0266210 A1 * 10/2009 Chung ..... B26B 5/003 83/144
2009/0277016 A1 * 11/2009 Wu ..... B26B 5/003 30/162
2010/0180449 A1 * 7/2010 van Deursen ..... B26B 5/001 30/162
2010/0223793 A1 * 9/2010 Hansen ..... B26B 5/001 30/162
2011/0041345 A1 * 2/2011 Austin ..... B26B 5/003 30/162
2011/0283542 A1 * 11/2011 Wu ..... B26B 5/003 30/162
2011/0283543 A1 * 11/2011 Wu ..... B26B 5/003 30/162
2012/0102754 A1 * 5/2012 Garavaglia ..... B26B 5/003 30/162
2013/0091712 A1 * 4/2013 Schekalla ..... B26B 5/003 30/162
2014/0041235 A1 * 2/2014 Hsu ..... B26B 5/003 30/162
2014/0053410 A1 2/2014 Huang
2014/0250695 A1 * 9/2014 Wagner ..... B26B 5/003 30/162
2015/0013171 A1 * 1/2015 Wu ..... B26B 5/003 30/162
2015/0239135 A1 * 8/2015 Chu ..... B26B 1/08 30/162
2016/0031097 A1 * 2/2016 Wu ..... B26B 1/08 30/162
2016/0046026 A1 * 2/2016 Ranieri ..... B26B 5/001 30/162
2016/0167239 A1 * 6/2016 Gallegos ..... B26B 1/08 30/162
2016/0193738 A1 * 7/2016 Schekalla ..... B26B 5/003 30/154
2016/0279811 A1 * 9/2016 Huang ..... B26B 1/08 30/162
2016/0311121 A1 * 10/2016 Wang ..... B26B 1/08 30/162

FOREIGN PATENT DOCUMENTS

DE 102015221874 A1 * 1/2017 ..... B26B 5/003
EP 1985417 A1 10/2008
EP 2700482 B1 * 11/2016 ..... B26B 1/08
JP 2005046539 A 2/2005
JP WO 2017057468 A1 * 4/2017 ..... B26B 1/08
TW 241613 2/1995
TW 357669 5/1999

* cited by examiner

UTILITY KNIFE

BACKGROUND OF THE INVENTION

1. Field of the Invention

The present invention relates to a utility knife and, particularly, to a utility knife assembled by hand and designed to be user-friendly and used safely.

2. Description of the Related Art

TW Pat. No. 357669 shows a utility knife deigned to be assembled in a quick manner. The utility knife includes a shell made up of two halves. A seat for receiving a blade is received by the two halves of the shell. The seat is movable on the shell. The two halves of the shell cooperate to form a channel and the seat is movably restrained on the channel. The seat is movable to a first position in which the blade extends out of the shell and to a second position in which the blade retracts inside the shell. One half of the shell includes an inner lateral side and a block formed on the lateral side defining a recess. Another half of the shell includes a lateral side, a hole through the lateral side, and a lock mounted thereon. The lock forms a joining end adapted to insert through the hole and to selectively engage in the recess. The lock is movable on the other half of the shell and is biased by a spring. The two halves of the shell can be assembled quickly and securely after the joining end of the lock engages in the recess, and the lock is in a first position. The two halves of the shell can be released from each other after the joining end of the lock disengages from the recess, and the lock is in a second position.

The spring can become fatigued or weak. As a result, the lock is unable to secure the halves of the shell together, and the shell is unable to retain the seat, the blade on the seat, and the lock.

The present invention is, therefore, intended to obviate or at least alleviate the problems encountered in the prior art.

SUMMARY OF THE INVENTION

According to the present invention, a utility knife includes a shell including a first shell body and a second shell body releasably assembled together. A compartment is defined by the first and second shell bodies. A channel is defined at a distal end of the first shell body of the shell and disposed outside of the compartment. A blade carrier assembly releasably engages with a blade and includes a seat movably received by the compartment of the shell. The blade carrier assembly is operably movable to a first position in which the blade is in a retracted position and not extending out of the shell and, to a second position in which the blade is in an exposed position and extending out of the shell. The blade carrier assembly in the second position thereof engages with the channel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
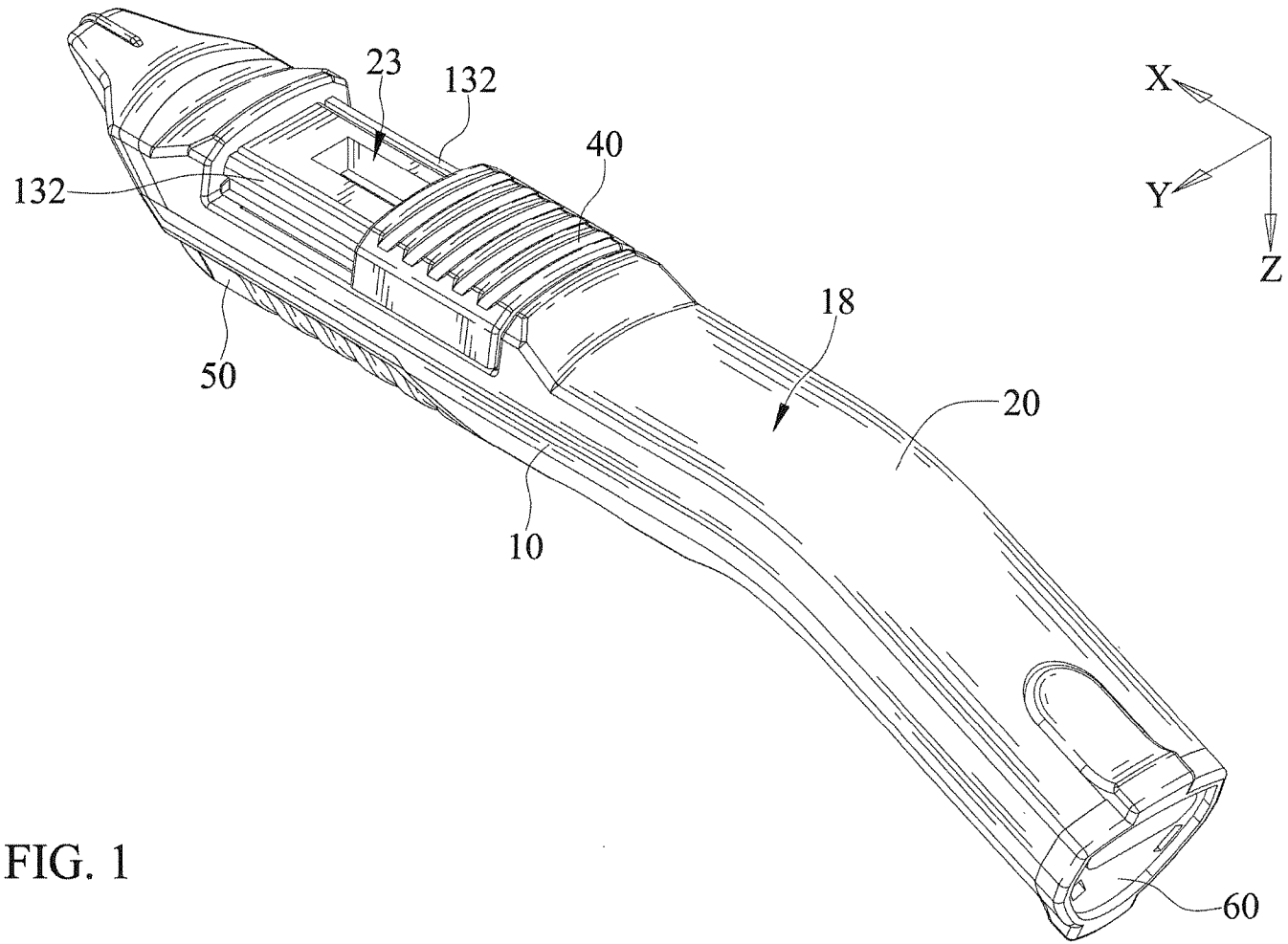
FIG. 1 is a perspective view of a utility knife in accordance with the present invention.
Figure 2:
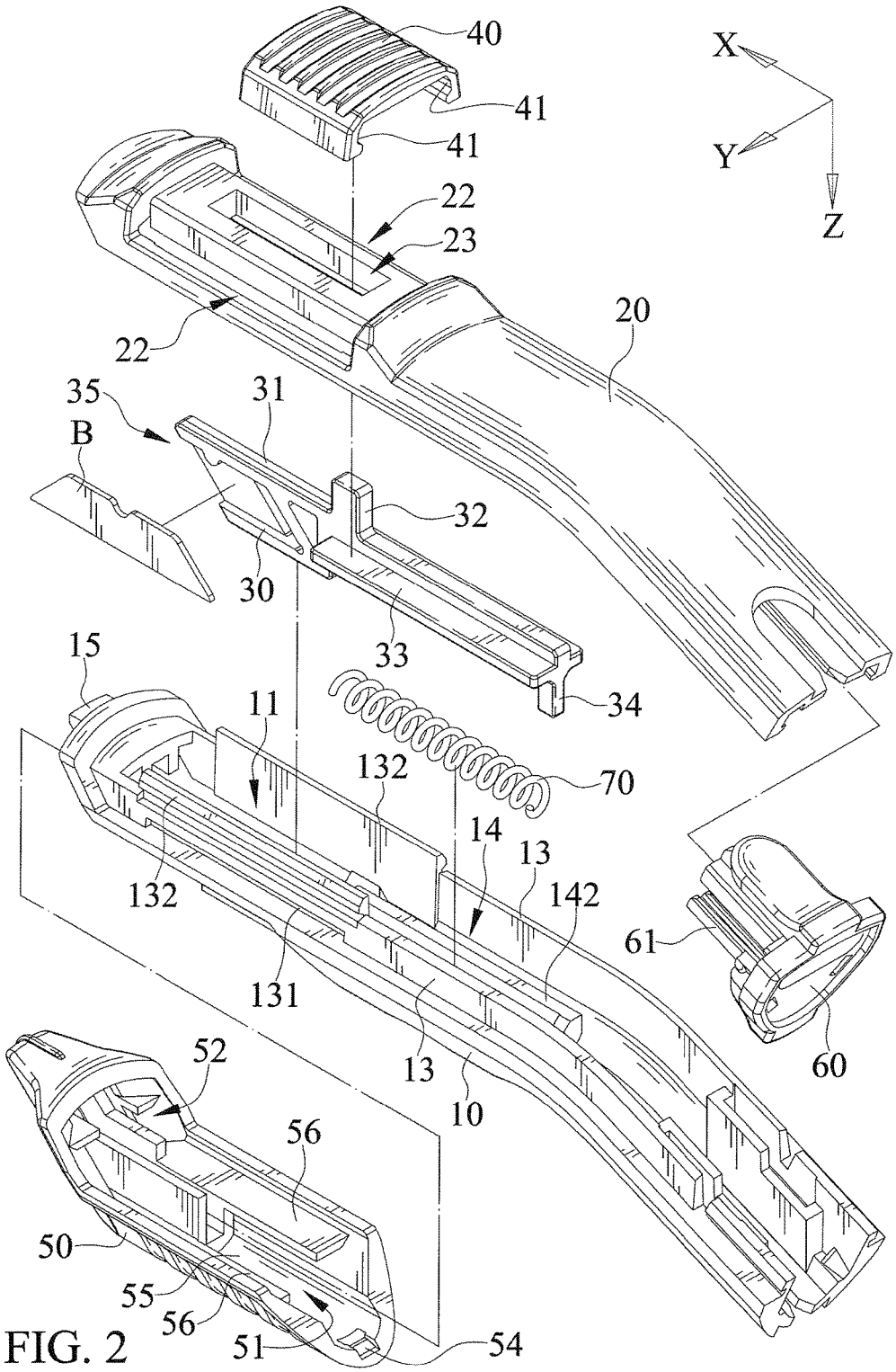
FIG. 2 is an exploded perspective view of the utility knife of the present invention.
Figure 3:
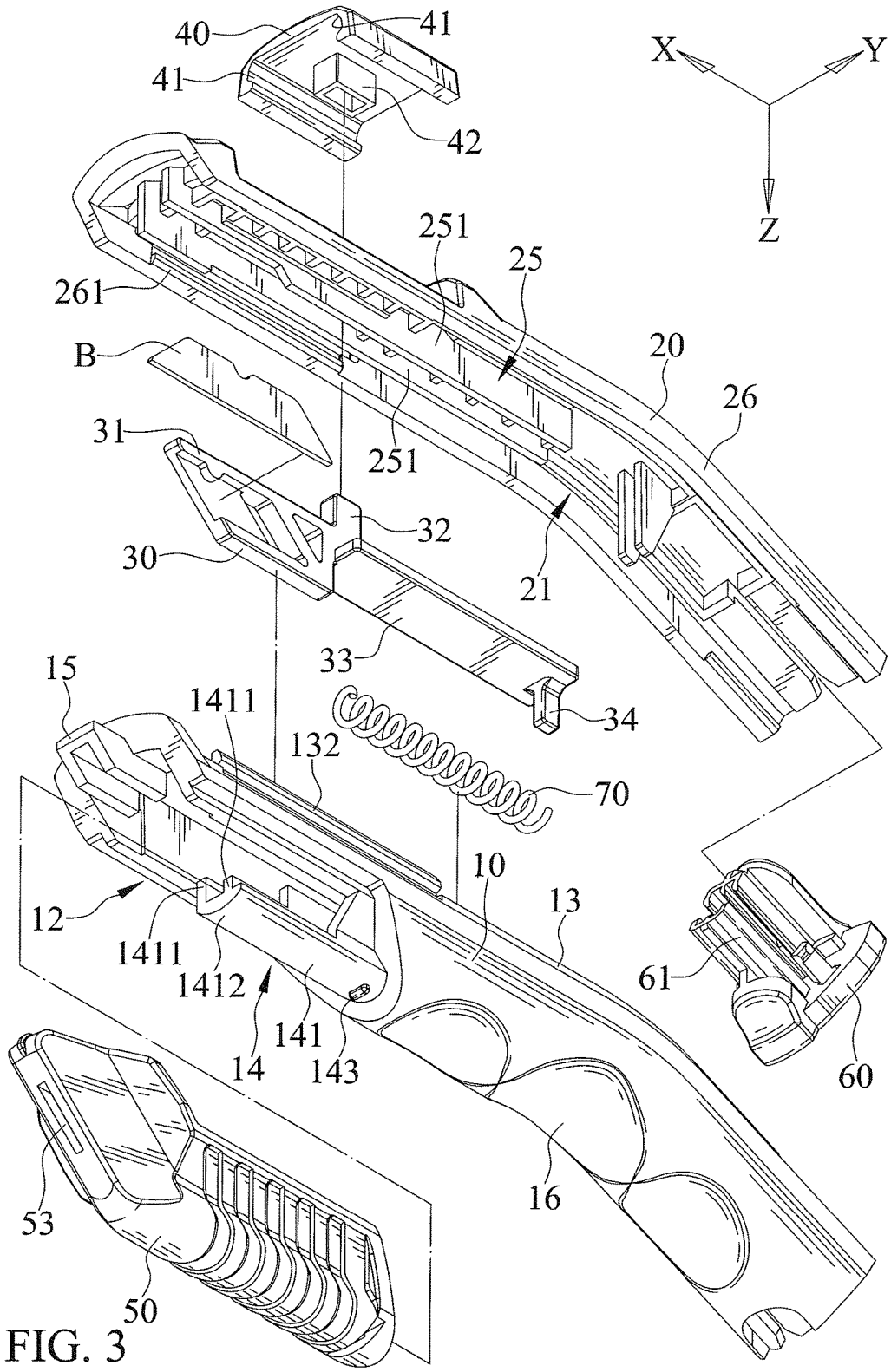
FIG. 3 is an exploded perspective view of the utility knife of the present invention, taken from a different angle than FIG. 2.
Figure 4:
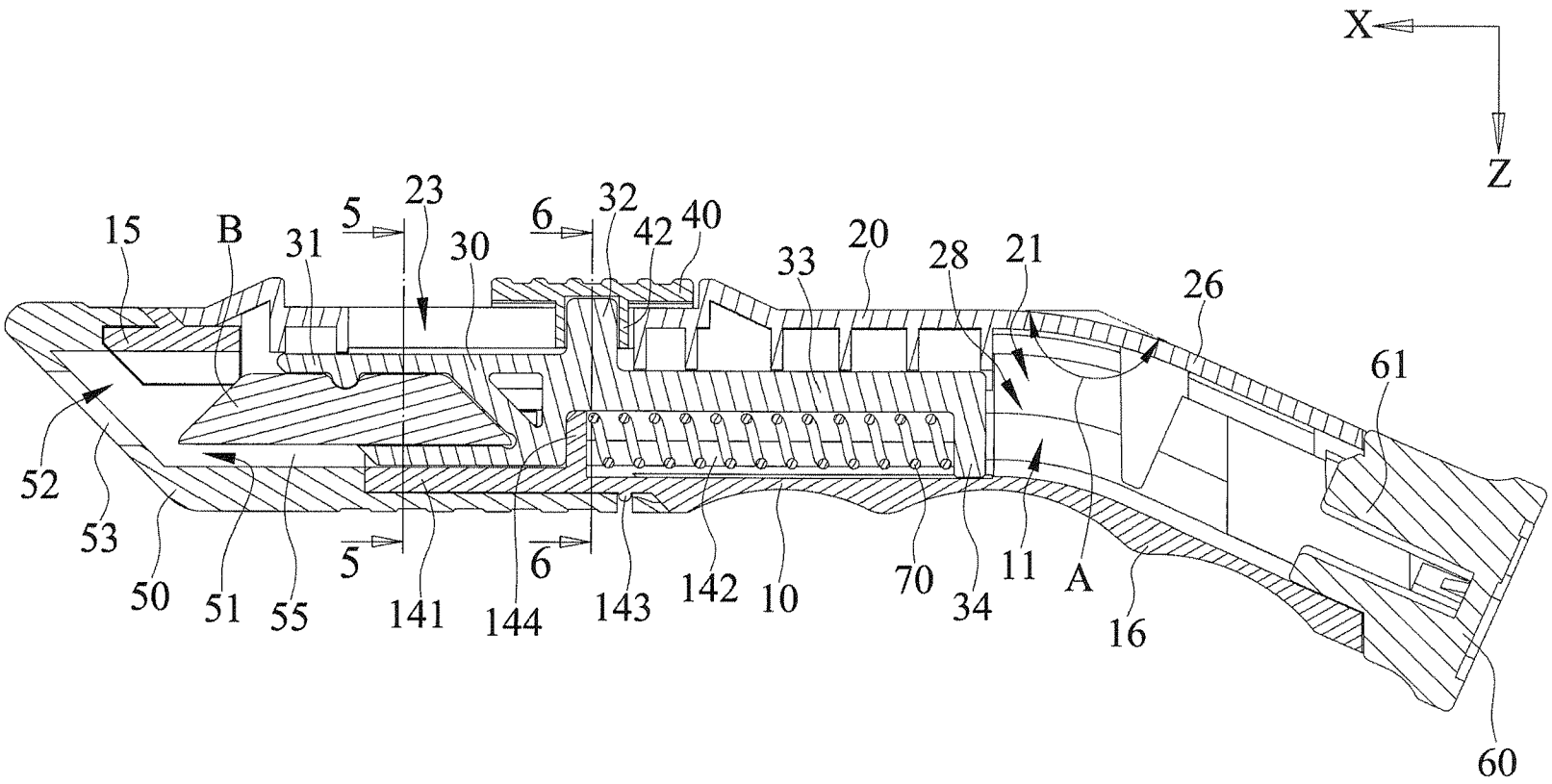
FIG. 4 is a cross-sectional view of the utility knife of the present invention shown in FIG. 1.
Figure 5:
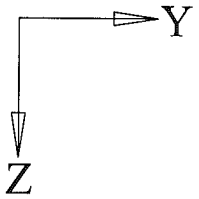
FIG. 5 is a cross-sectional view of the utility knife of the present invention taken along line 5-5 of FIG. 4.
Figure 5:
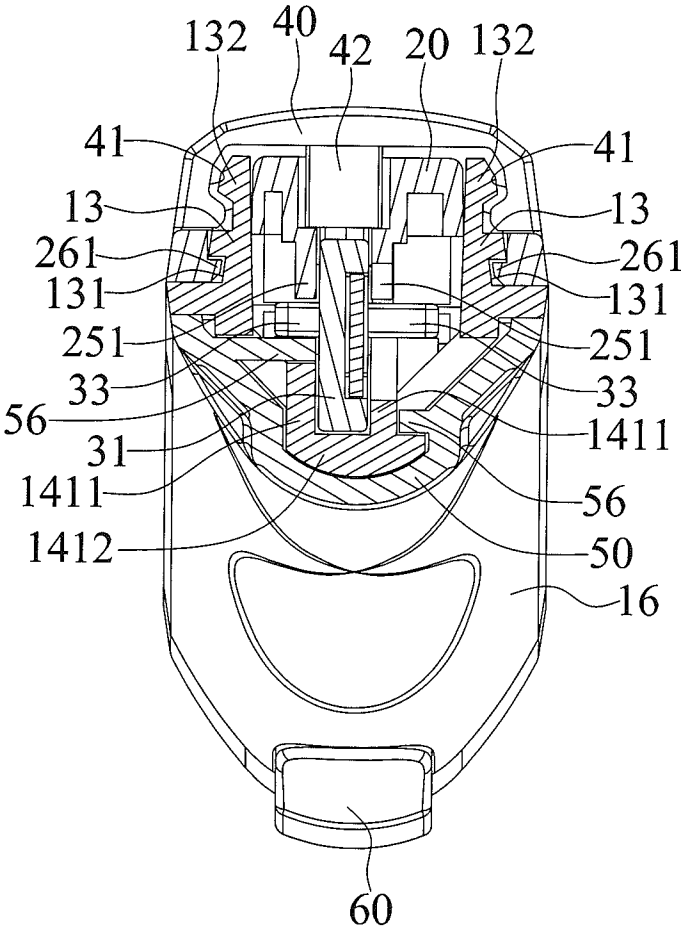
Figure 6:
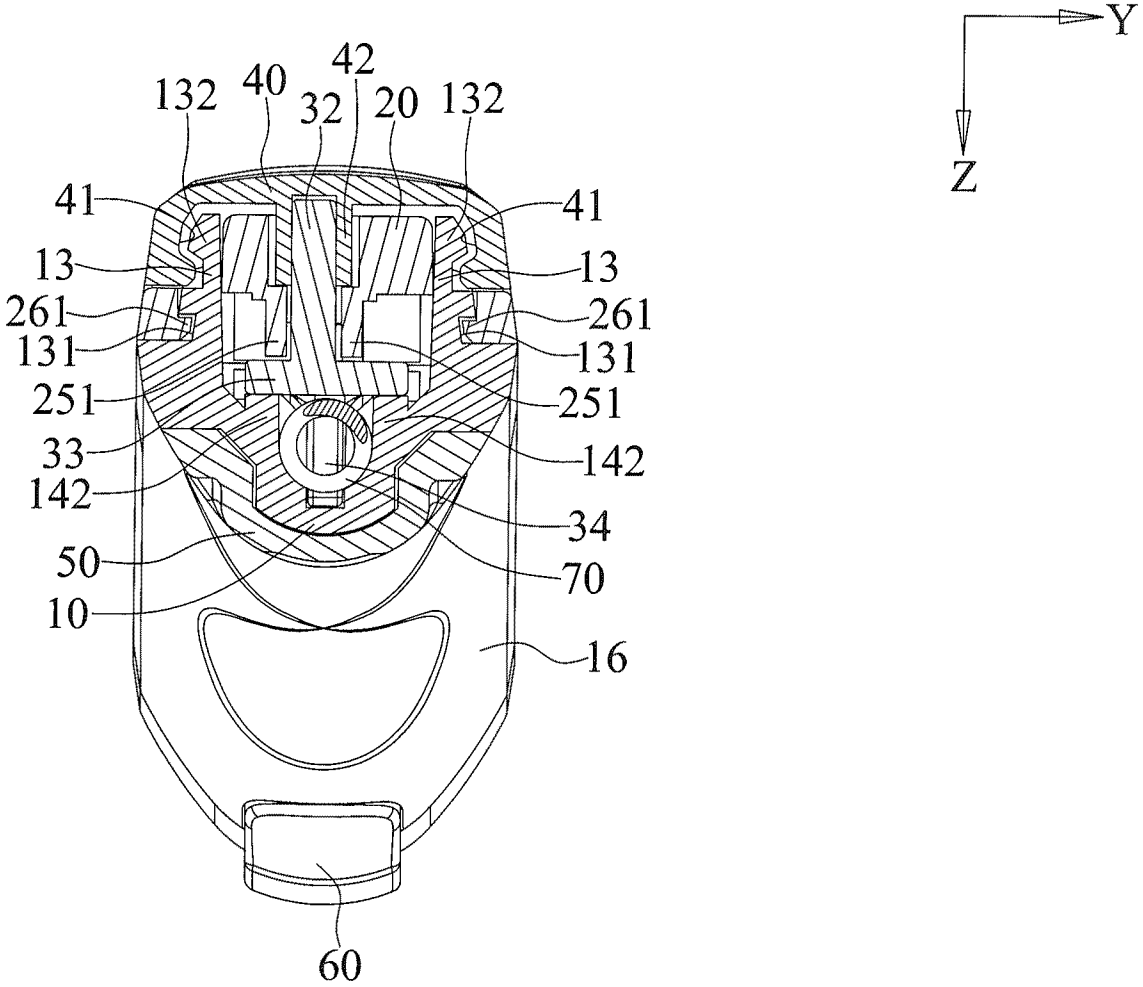
FIG. 6 is a cross-sectional view of the utility knife of the present invention taken along line 6-6 of FIG. 4.

FIGS. 2 through 7 show a utility knife in accordance with the present invention.

A shell 18 includes a first shell body 10 and a second shell body 20 releasably assembled together in a Z-axis direction. The first shell body 10 includes a first mounting structure forming an inner wall 13 of the first shell body 10. The second shell body 20 includes a second mounting structure forming an inner wall 26 of the second shell body 20. The first and second mounting structures engage together when the first and second shell bodies 10 and 20 are assembled together. The first and second mounting structures are snap fitted. The first mounting structure includes a first snap-fit design forming a recess 131. The second mounting structure includes a second snap-fit design forming a hook 261. A compartment 28 is enclosed by the first and second shell bodies 10 and 20. The first shell body 10 of the shell includes a channel 15 located at a distal end of the first shell body 10 of the shell 18 and is disposed outside of the compartment 28. The first shell body 10 includes a first cavity 11. The first cavity 11 is defined by the first shell body 10. The second shell body 20 includes a second cavity 21. The second cavity 21 is defined by the second shell body 20. When the first and second shell bodies 10 and 20 are assembled together, the first and second cavities 11 and 21 cooperate to define the compartment 28. The shell is made of plastic.

A blade carrier assembly 35 releasably engages with a blade B and is movably received by the shell 18. The blade carrier assembly 35 includes a seat 30 disposed inside the shell 18. A groove 14 is defined by the first shell body 10. The seat 30 is movably received by the groove 14. The groove 14 has peripheral walls extending from the first shell body 10. The peripheral walls of the groove 14 includes two first lateral sides 1411 and a bottom side 1412. The groove 14 and the channel 15 are aligned in an X-axis direction. The X-axis direction, as shown, is perpendicular to the Z-axis direction. The groove 14 partially extends outside the compartment 28 with a first length and defines a first section 141 of the groove 14. The groove 14 partially extends inside the compartment 28 with a second length and defines a second section 142 of the groove 14. The seat 30 defines a blade receiving area 31 for receiving the blade B. The blade receiving area 31 is at a first distal end of the seat 30. The blade receiving area 31 is received by the first section 141 of the groove 14. The blade B is designed to be of trapezoidal shape. The shape of the blade B defines a shorter base with a notch. The blade receiving area 31 defines a recess having a contour matching to a shape of the blade B and including three peripheral sides. The three peripheral sides of the blade receiving area 31 bound the shorter base and another two sides of the blade B. Another two sides of the blade B are a longer base and a leg extending between the shorter and longer bases. The shorter and longer bases are parallel to one another. The blade receiving area 31 has a protruded area received by the notch of the blade B. The seat 30 has a supporting edge 33. The groove 14 is also delimited by two first lateral sides 1411. The two first lateral sides 1411 are configured for bearing the supporting edge 33. The supporting edge 33 is mounted on the two first lateral sides 1411 and disposed outside of a space between the two first lateral sides 1411. The supporting edge 33 moves on the two first lateral sides 1411 of the groove 14 when the blade carrier assembly 35 is moved. Two second lateral sides 251 delimiting a groove 25 also abut the supporting edge 33. The groove 25 is delimited by the two second lateral sides 251 extending from the second shell body 20. The supporting edge 33 is disposed outside of a space between by the two second lateral sides 251 of the groove 25. The supporting edge 33, therefore, includes one of two opposed sides abutting on the first lateral sides 1411 of the groove 14 and another of the two opposed sides abutting on the second lateral sides 251 of the groove 25, respectively. The blade carrier assembly 35 is made of plastic. The blade B is specially made of ceramic material.

The blade carrier assembly 35 further includes an input control 40 releasably mounted on the seat 30. The input control 40 is adapted to be used to operably move the seat 30. The input control 40 and the shell 18 are releasably engaged with each other. The input control 40 is disposed outside the compartment 28. The input control 40 and the shell 18 are releasably engaged with each other in a manner that the input control 40 is prevented from disengaging from the shell 18 inadvertently, with the input control 40 including at least one joining structure and the shell 18 including at least one retaining structure releasably engaging with the at least one joining structure. The at least one joining structure forms an extension 41. The at least one retaining structure forms a rail 132. The input control 40 includes the extension 41 engaging with and being movable on the rail 132, which extends on the first shell body 10. The input control 40 is U shaped and the at least one joining structure forms two extensions 41. The rail 132 is disposed between the two extensions 41. The rail 132 extends in an upward direction from the first shell body 10 and has a first distal end fixed to the first shell body 10 and a second distal end defining a free end. Each extension 41 extends in a downward direction from the body extending between the extension 41 and has a first distal end fixed to the body and a second distal end defining a free end. The at least one retaining and the at least one joining structures are snap fitted. When the at least one joining structures and the at least one retaining structures are engaged with each other, the at least one retaining structures and the at least one joining structures are disposed one on top of another. When disengaging the input control 40 from the shell 18, the at least one joining structure and the at least one retaining structure can be moved laterally away from each other to disengage from each other. Then, the input control 40 can disengage from the shell 18. A slot 23 is defined by the second shell body 20 and positioned between two lateral sides of the rail 132. The input control 40 and the seat 30 are releasably engaged with each other in a manner that the input control 40 is prevented from disengaging from the seat 30, with the seat 30 including a first connecting end and the input control 40 including a second connecting end releasable engaging with the first connecting end. The first and second connecting ends and are insertable into the slot 23. The first connecting end forms a protrusion 32. The second connecting end defines a hole 42. By connecting the first connecting end to the second connecting end, the seat 30 and the input control 40 are connected. The slot 23 is positioned closer to one lateral side of the rail 132 than the other. The second connecting end is positioned closer to one of the extensions 41 than the other. Accordingly, the input control 40 will not be installed on the shell 18 in the wrong direction.

Figure 7:
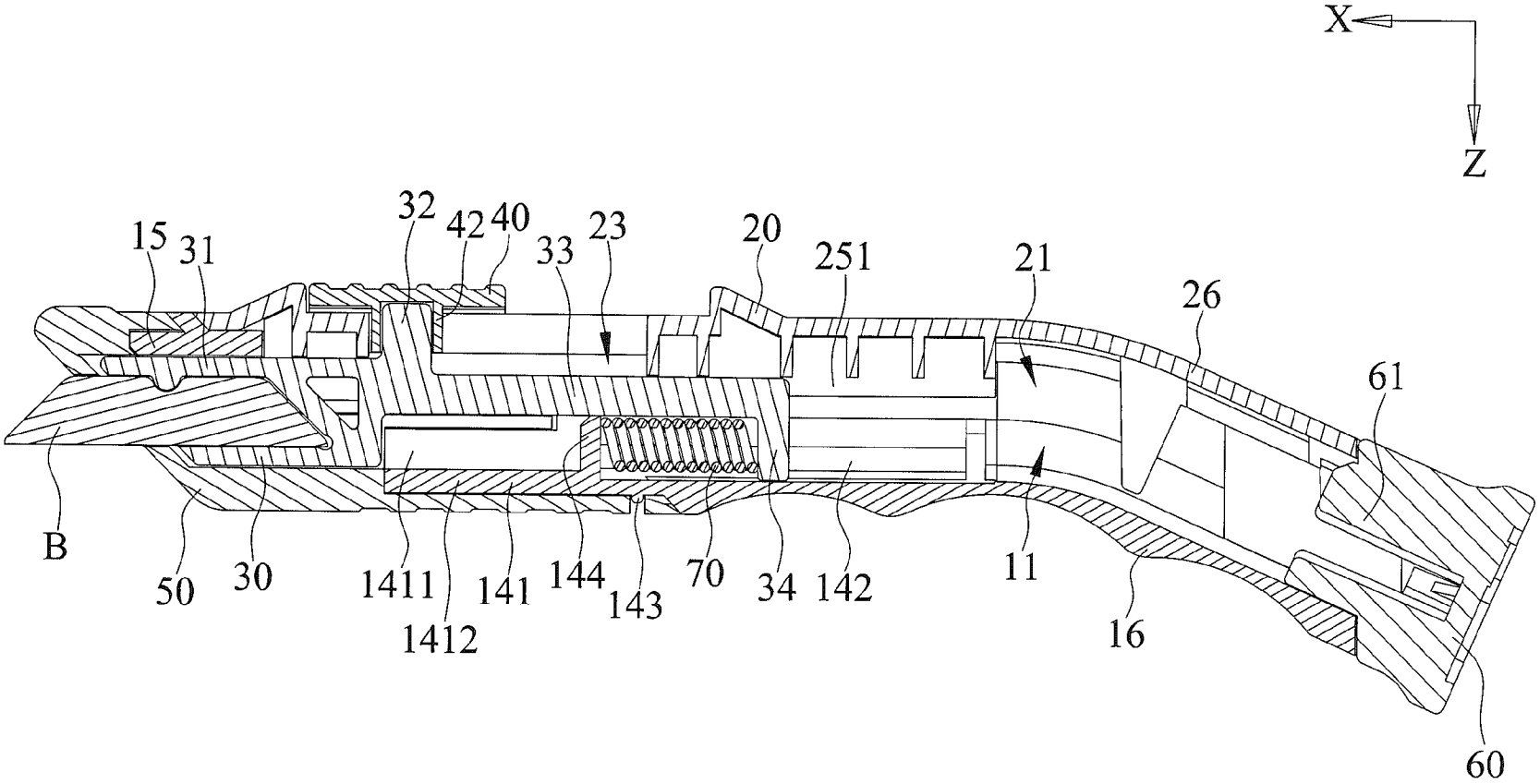
FIG. 7 is a cross-sectional view of the utility knife of the present invention, taken in the same cross-sectional plane as FIG. 4, but in a position in which a blade of the utility knife is exposed.

The seat 30 of the blade carrier assembly 35 is adapted to be moved by operating the input control and is movable to a first position in which the blade is in a retracted position and not extending out of the shell 18 and, to a second position in which the blade is in an exposed position and extending out of the shell 18. The blade carrier assembly 35 in the second position thereof is engages with the channel 15, as shown in FIG. 7.

An opening 12 is defined by the first shell body 10 and the shell 18 includes a third shell body 50 assembled thereto and selectively disposed at a position enclosing the opening 12. The third shell body 50 is releasably assembled to the shell 18. The opening 12 communicates with the compartment 28. The third shell body 50 encloses walls of the channel 15 as well as the first section 141 of the groove 14. The third shell body 50 includes a third cavity 51 and a fourth cavity 52 communicating with the third cavity 51. The third and fourth cavities 51 and 52 are located on opposite ends of the third shell body 50. When the first, second, and third shell bodies 10, 20, and 50 are assembled together, the walls of the channel 15 are disposed in the fourth cavity 52. The third shell body 50 and the bottom side 1412 of the first section 141 of the groove 14 are releasably engaged with each other in a manner that the third shell body 50 is prevented from disengaging from the groove 14 inadvertently, with the first section 141 of the groove 14 includes a first constraining structure and the third shell body 50 includes a second constraining structure releasably engaging with the first constraining structure. The first constraining structure defines a protrusion 143 and the second constraining structure defines a cavity 54. The protrusion 143 protrudes from the bottom side 1412 of the groove 14. The cavity 54 extends through the third shell body 50. The second constraining structure is adjacent to a second distal end of the third shell body 50. A passage 55 and a positioning ridge 56 are located in the third shell body 50 and the bottom side 1412 of the first section 141 of the groove 14 is received by the passage 55 and positioned by the positioning ridge 56, with the first section 141 of the groove 14 including the bottom side 1412 received by the passage 55, and with the first section 141 of the groove 14 including at least one first lateral side 1411 extending upward from the bottom side 1412 and the positioning ridge 56 disposed on the at least one lateral side 1411. As set forth, the first section 141 of the groove 14 includes two lateral sides 1411 and the bottom side 1412 extending between the two lateral sides 1411. Each of the two lateral sides 1411 extends in an upward direction from the bottom side 1412 and has a first distal end fixed to the bottom side 1412 and second distal end defining a free end. The seat 30 is movably received by a cavity, i.e. the fourth cavity 52. The fourth cavity 52 is located in the third shell body 50. The third shell body 50 includes a slit 53 extending therethrough and aligned with the blade B. The slit 53 is at a first distal end of the third shell body 50. The blade B is insertable through the slit 53. The blade B extends out of the slit 53 when the blade carrier assembly 35 is at the second position thereof.

Another opening is defined by the first and second shell bodies 10 and 20 and the shell 18 includes a cap 60 assembled thereto and selectively disposed at a position enclosing another opening, with the cap 60 forming prongs 61 releasably retaining on the shell 18. The cap 60 can be disengaged from the shell 18 to allow the compartment 28 to be open.

The blade carrier assembly 35 is under a resilient force exerted by a resilient member 70. The resilient member 70 has an initial length. The resilient member 70 is compressed and the initial length is reduced when the blade carrier assembly 35 is in the first position thereof. The resilient member 70 is uncompressed and the initial length is restored when the blade carrier assembly 35 is in the second position thereof. The resilient member 70 is disposed in the groove 14 and between a retaining end defined by the seat 30 and a projection protruding from a peripheral wall of the groove 14. The retaining end forms a protrusion 34. The retaining end 34 and the first connecting end 32 extend in opposite directions. The retaining end is at a second distal end of the seat 30. The retaining end is received by the groove 14. The projection forms a partition wall 144, and the resilient member 70 is disposed between the retaining end and the partition wall 144. The partition wall 144 partitions the first and second sections 141 and 142 of the groove 14.

The blade receiving area 31 is fully exposed by dissembling the third shell body 50 from the shell 18 and moving the blade carrier assembly 35 to the second position thereof. Accordingly, the blade B can be fit easily and quickly to the seat 30 of the blade carrier assembly 35.

Furthermore, the utility knife has ergonomic designs in that it has a shape having a length in the X-direction, with the length including an aggregate of a first length measuring a first section of the utility knife from a first distal end to an intermediate end of the utility knife and a second length measuring a section of the utility knife from the intermediate end to the second distal end of the utility knife. The first and second sections of the utility knife are angled and include an obtuse included angle A. Also, at least one finger indentation 16 is formed on the shell 18 for a comfortable, secure grip of the utility knife. The at least one finger indentation 16 is positioned on a lower side of the shell 18, whereas the input control 40 is positioned on an upper side of the shell 18.

In view of the forgoing, the utility knife is adapted to be assembled by hand and is designed to be user-friendly and to be used safely.

The foregoing is merely illustrative of the principles of this invention, and various modifications can be made by those skilled in the art without departing from the scope and spirit of the invention.

What is claimed is:

1. A utility knife comprising:

a shell including a first shell body and a second shell body releasably assembled together, with the first shell body having a first cavity cooperating with a second cavity of the second shell body to define a compartment;

a channel defined at a distal end of the first shell body of the shell and disposed outside of the first shell body;

a blade;

a seat having a blade receiving area releasably receiving the blade, wherein the seat is movably received by the first and second cavities; and an input control releasably mounted on the seat, wherein the seat is operably moved by the input control, and wherein the input control is disposed outside of the first and second shell bodies, wherein the seat is movable to a first position in which the blade is in a retracted position and not extending out of the shell and to a second position in which the blade is in an exposed position and extending out of the shell; and wherein the seat in the second position thereof engages with the channel.

2. The utility knife as claimed in claim 1, wherein the blade is of a trapezoidal shape, wherein the trapezoidal shape of the blade defines a shorter base with a notch, wherein the blade receiving area defines a recess having a contour matching to the trapezoidal shape of the blade and including three peripheral sides, wherein the three peripheral sides of the blade receiving area bound the shorter base and another two sides of the blade, and wherein the blade receiving area has a protruded area received by the notch of the blade.

3. The utility knife as claimed in claim 1, with a shape of the utility knife having a length, with the length including an aggregate of a first length measuring a first section of the utility knife from a first distal end to an intermediate end of the utility knife and a second length measuring a section of the utility knife from the intermediate end to the second distal end of the utility knife, and wherein the first and second sections of the utility knife are angled with respect to each other and include an obtuse included angle.

4. The utility knife as claimed in claim 1, with the first shell body further comprising a peripheral wall defining a groove located in the first cavity, and wherein the seat is movably received by the groove.

5. The utility knife as claimed in claim 4, wherein the seat has a supporting edge and the peripheral wall forms two lateral sides bearing the supporting edge, wherein the supporting edge is disposed outside of a space between the two lateral sides, and wherein the supporting edge moves on the two lateral sides when the seat is moved.

6. The utility knife as claimed in claim 4, wherein the seat is under a resilient force exerted by a resilient member, wherein the resilient member is disposed in the groove and between a retaining end defined by the seat and a projection protruding from the peripheral wall defining the groove, wherein the resilient member has an initial length, wherein the resilient member is compressed and the initial length is reduced when the seat is in the first position thereof, and wherein the resilient member is uncompressed and the initial length is restored when the seat is in the second position thereof.

7. The utility knife as claimed in claim 6, wherein the groove has a first section and a second section, wherein the second section extends outside the first shell body, wherein the first section extends inside the first and second cavities, and wherein the blade receiving area is received by the first section.

8. The utility knife as claimed in claim 7, with the first shell body further comprising an opening, wherein the shell further includes a third shell body releasably assembled to the first shell body and selectively disposed at a position enclosing the opening, wherein the channel and the first section of the groove are enclosed by the third shell body, wherein the seat is movably received by a cavity defined by an inner wall of the third shell body, wherein the third shell body includes a slit extending therethrough and aligned with the blade, wherein the blade is insertable through the slit, and wherein the blade extends out of the slit when the seat is in the second position thereof.

9. The utility knife as claimed in claim 8, wherein the third shell body and the first section of the groove are releasably engaged with each other, and wherein the first section of the groove includes a first constraining structure and the third shell body includes a second constraining structure releasably engaging with the first constraining structure.

10. The utility knife as claimed in claim 8, with the inner wall of the third shell body further comprising a passage and a positioning ridge, wherein the first section of the groove is movably received by the passage and positioned by the positioning ridge, with the first section of the groove including a bottom side on the passage, and with the first section of the groove including at least one lateral side extending upward from the bottom side and the positioning ridge disposed on the at least one lateral side.

11. The utility knife as claimed in claim 1, wherein the input control and the first shell body are releasably engaged with each other, with the input control including at least one joining structure and the first shell body including at least one retaining structure releasably engaging with the at least one joining structure, wherein the second shell body includes at least one rail, and wherein the input control includes an extension engaging with and being movable along the at least one rail.

12. The utility knife as claimed in claim 11, wherein the input control is U shaped and includes two legs defining two joining structures, and wherein the at least one rail is disposed between the two joining structures.

13. The utility knife as claimed in claim 11, with the at least one rail comprising two rails, with the utility knife further comprising a slot defined by the second shell body and positioned between two lateral sides of the two rails, wherein the input control and the seat are releasably engaged with each other, with the seat defining a first connecting end and the input control defining a second connecting end releasably engaging with the first connecting end, and wherein the first and second connecting ends are insertable into the slot.

14. The utility knife as claimed in claim 13, wherein the slot is positioned closer to one of the two lateral sides of the two rails than another of the two lateral sides, and wherein the second connecting end is positioned closer to one of the two joining structures than another of the two joining structures.

15. The utility knife as claimed in claim 1, with the first shell body further comprising an opening, wherein the shell further includes a third shell body releasably assembled to the first shell body and selectively disposed at a position enclosing the opening, wherein the the channel is enclosed by the third shell body, wherein the seat is movably received by a cavity defined by an inner wall of the third shell body, wherein the third shell body includes a slit extending therethrough and aligned with the blade, wherein the blade is insertable through the slit, and wherein the blade extends out of the slit when the seat is in the second position thereof.

16. The utility knife as claimed in claim 15, with the first and second shell bodies further comprising another opening, wherein the shell further includes a cap assembled thereto and selectively disposed at a position enclosing the other opening, with the cap forming prongs releasably retaining on the shell.

17. The utility knife as claimed in claim 1, with the first shell body further comprising at least one finger indentation.

* * * * *